United States Patent [19]

Zimmermann

[11] 4,282,698

[45] Aug. 11, 1981

[54] LIQUID FILLING MACHINE

[76] Inventor: Guenter Zimmermann, 600 Casler Ave., Clearwater, Fla. 33515

[21] Appl. No.: 67,735

[22] Filed: Aug. 20, 1979

[51] Int. Cl.[3] ..... B65B 3/04; B65B 61/02; B65B 61/06; B67B 3/04

[52] U.S. Cl. ..... 53/282; 53/131; 53/297; 53/298; 53/300; 53/329; 221/223

[58] Field of Search ..... 53/298, 297, 300, 329, 53/373, 131, 281, 282, 283; 264/509; 156/69; 425/DIG. 33, 193, 394; 221/223, 297

[56] References Cited

U.S. PATENT DOCUMENTS

| | | | |
|---|---|---|---|
| 1,344,692 | 6/1920 | Hill | 221/223 |
| 2,445,958 | 7/1948 | Lindstrom | 221/223 |
| 2,972,216 | 2/1961 | Schmidt | 53/281 |
| 3,078,630 | 2/1963 | Mayer, Jr. et al. | 53/131 X |
| 3,354,614 | 11/1967 | St. Clair et al. | 53/329 X |
| 3,527,020 | 9/1970 | Mancini | 53/300 X |
| 3,575,755 | 4/1971 | Cutler et al. | 53/131 X |
| 3,716,963 | 2/1973 | Amberg | 53/329 X |
| 3,792,566 | 2/1974 | Kinney | 53/329 X |
| 3,795,346 | 3/1974 | Roberts et al. | 221/223 |
| 3,838,550 | 10/1974 | Mueller | 53/329 X |
| 4,130,623 | 12/1978 | Walter | 425/394 X |
| 4,176,507 | 12/1979 | Mancini | 53/282 X |

*Primary Examiner*—Horace M. Culver
*Attorney, Agent, or Firm*—Arthur W. Fisher, III

[57] ABSTRACT

A liquid filling machine comprising a plurality of discrete stations that cooperatively provide for automatic filling and capping containers including a cup dispensing station, a liquid filling station, a foil supply station, a heat sealing station and discharge station operatively disposed about a rotatably mounted container support to sequentially feed containers from the cup dispensing station to the container support and incrementally advance the container support through each discrete station to fill, seal and discharge the filled container.

18 Claims, 5 Drawing Figures

FIG. 2A
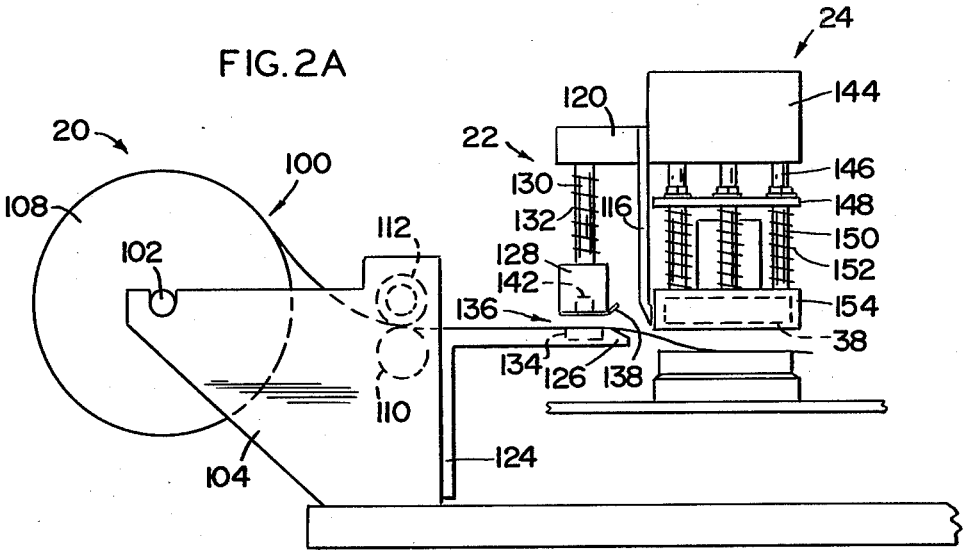
FIG. 2B
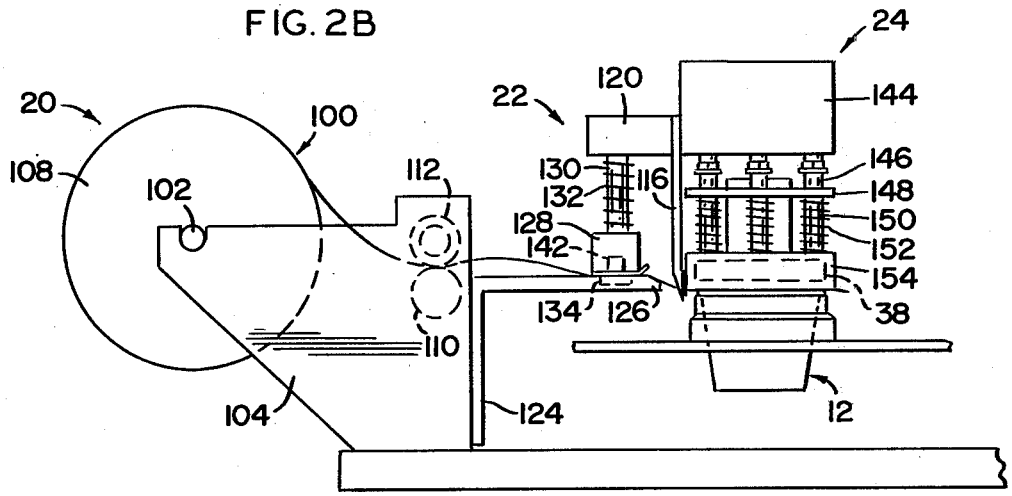
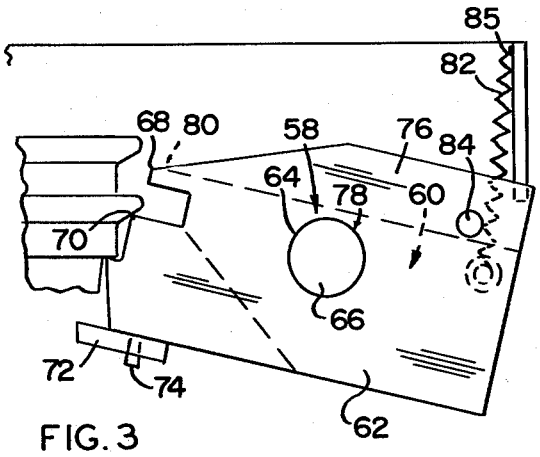
FIG. 3
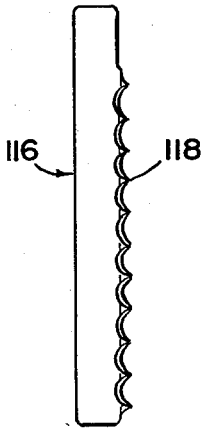
FIG. 4

LIQUID FILLING MACHINE

BACKGROUND OF THE INVENTION

1. Field of the Invention

A liquid filling machine comprising a plurality of discrete stations that cooperatively provide for the automatic filling and capping of containers.

2. Description of the Prior Art

A vast number of automatic filling machines have been designed to apply preformed lids or caps to close the filled cups or containers. Generally such machines employ a relatively limited supply of lids or caps. This requires unnecessary operator attention to replenish the supply.

To reduce the need of replenishing the lid or cap supply, machines using foil rolls have been developed. Unfortunately such machines often become fouled with the foil as it is fed from the foil roll.

In addition numerous machines often imprint or emboss the lids or foil strip with an identification code. The use of foil rolls is greatly inhibited since the code may be removed or obliterated.

Thus a real need exists for an automatic filling machine capable of code identification with a significant number of lids or foil closures.

SUMMARY OF THE INVENTION

The present invention relates to a liquid filling machine comprising a plurality of discrete stations that cooperatively provide a means of automatically filling plastic containers with a liquid and capping the cups for ultimate use. The plurality of discrete stations includes a control module, a cup dispensing station, a liquid filling station, a foil supply station, a code identification station, a heat sealing station, a discharge station and a rotatable turn table or container support all operatively mounted on a base.

The control module comprises state of the art circuitry disposed within a control housing to control the sequential operation of the liquid filling machine.

The cup dispensing station comprises four (4) substantially vertical retainer members supported on a housing. A cup release mechanism is disposed within the housing to selectively feed the cups to the container support. The cup release mechanism comprises a pair of cup release elements each comprising a first and second release member. The first release member comprises a first plate including an aperture to fixedly attach the first release member on a rotatable shaft. An upper and lower release element extend outwardly from the first plate in cup engaging disposition. An adjustable centering element is movable attached to the lower edge of the first plate to permit selective movement of the adjustable centering element. The second release member comprises a second plate including aperture to rotatably mount the second release member on the rotatable shaft. An upper stop element extends outwardly from the second plate in cup engaging disposition. Upward movement of the second plate is restricted by a limit member extending downwardly from the second member. The shaft is coupled to the drive means or motor by a mechanical coupling means.

The liquid filling station comprises a vertically disposed liquid reservoir having a liquid fill nozzle extending outwardly therefrom in liquid filling disposition relative to the container support means 28.

The foil supply station comprises a foil mounting means to hold a continuous roll of foil. The tape or foil is fed through a tape drive means comprising a lower metal drive roller and an upper rubber idle roller. This configuration allows the foil to preform in a downward trend since the rubber idle roller tends to deform and follow the shape of the drive roller.

The foil supply station further includes a cutting means comprising a substantially vertical cutting member or blade including a plurality of cutting elements extending across a portion thereof. As described more fully hereinafter, the tape or foil is only partially cut or perforated. The cutting blade is fixedly attached to a support member operatively coupled to the drive motor by a drive linkage or mechanical coupling to reciprocally move the support member.

The code identification station comprises an embossing head. A detachable coding plate is mounted in a retainer means. A securing means or magnetic means is secured to the embossing head to retain the coding plate on the embossing head.

The heat sealing station of essentially conventional design comprising a base support rods, a plate with interconnecting rods and a bias extending downwardly therefrom. The heat sealing head including a heater element is attached to the lower portion of the interconnecting rods. The entire heat sealing station is operatively coupled to the drive means by a mechanical coupling.

It should be noted that the cutting element extends below the embossing head and the heat sealing head only in the lower or cutting position. As a result, when the embossing head and heat sealing head engage the strip of foil, sealing head without a cup no slice or cut only perforated thereafter continuous strip and no fouling.

The discharge station comprises a lifter pedestal mounted on the base to move vertically between a lower and upper position relative to a discharge plate including a discharge aperture to register with the container support to receive filled cups therefrom. A wiper structure or means comprising a rotatable vertical wiper shaft and a horizontal wiper arm are mounted on the base to sweep the cups from the lifter pedestal when in the upper position. The lifter pedestal and a wiper shaft are operatively coupled to the drive motor by a drive linkage or mechanical couplings.

The container support comprises a circular horizontally disposed turn table attached to the upper portion of a turn table shaft operatively coupled to the drive motor by a drive linkage or mechanical coupling. A plurality of container retainers each comprising a container aperture having an annular cup pocket disposed therein are formed in the turn table.

In use the liquid filling machine is actuated by a plurality switches. The cups vertically disposed within the retainer members serially and singly feed under the control of the cup release mechanism. The adjustable centering elements on each side of the cup maintains center line alignment to prevent the cup from inadvertently becoming dislodged from either the lower release element or upper stop element during operation. Once the lowermost cup is released, the first and second release members and rotate upwardly for reloading. The turn table is then driven one increment immediately below the liquid filling station where it is filled volumetrically. As the turn table continues to advance or rotate through two increments the uncapped cup is disposed immediately below the heat sealing head. As the cup passes from the liquid filling station to the heat sealing station the strip of foil is fed from the foil supply to cover the opening of the cup. Once the cup is disposed beneath the heat sealing station, the heat sealing head, the cutting blade and the coding plate are moved downwardly such that the strip of foil is securely held between the code station and heat sealing station permitting a partial cutting of the strip. As the turn table is then rotated, the strip being bonded to the cup, the linear travel of the turn table being relatively greater than the travel of the foil strip causes a tearing of the remaining portion of the strip releasing the foil closure formed on the cup.

As the turn table continues to rotate, the pedestal moves upwardly forcing the enclosed cup, through the aperture in the discharge plate. The wiper arm then rotates, pushing the filled enclosed cup down along the discharge plate. The operation is thus continued.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIGS. 2A and 2B are partial side views of the liquid filling machine.

FIG. 3 is a detailed view of the cup release mechanism.

FIG. 4 is a detailed view of the cutting blade.

Similar reference characters refer to similar parts throughout the several views of the drawings.

DETAILED DESCRIPTION OF THE PREFERRED EMBODIMENT

Figure 1:
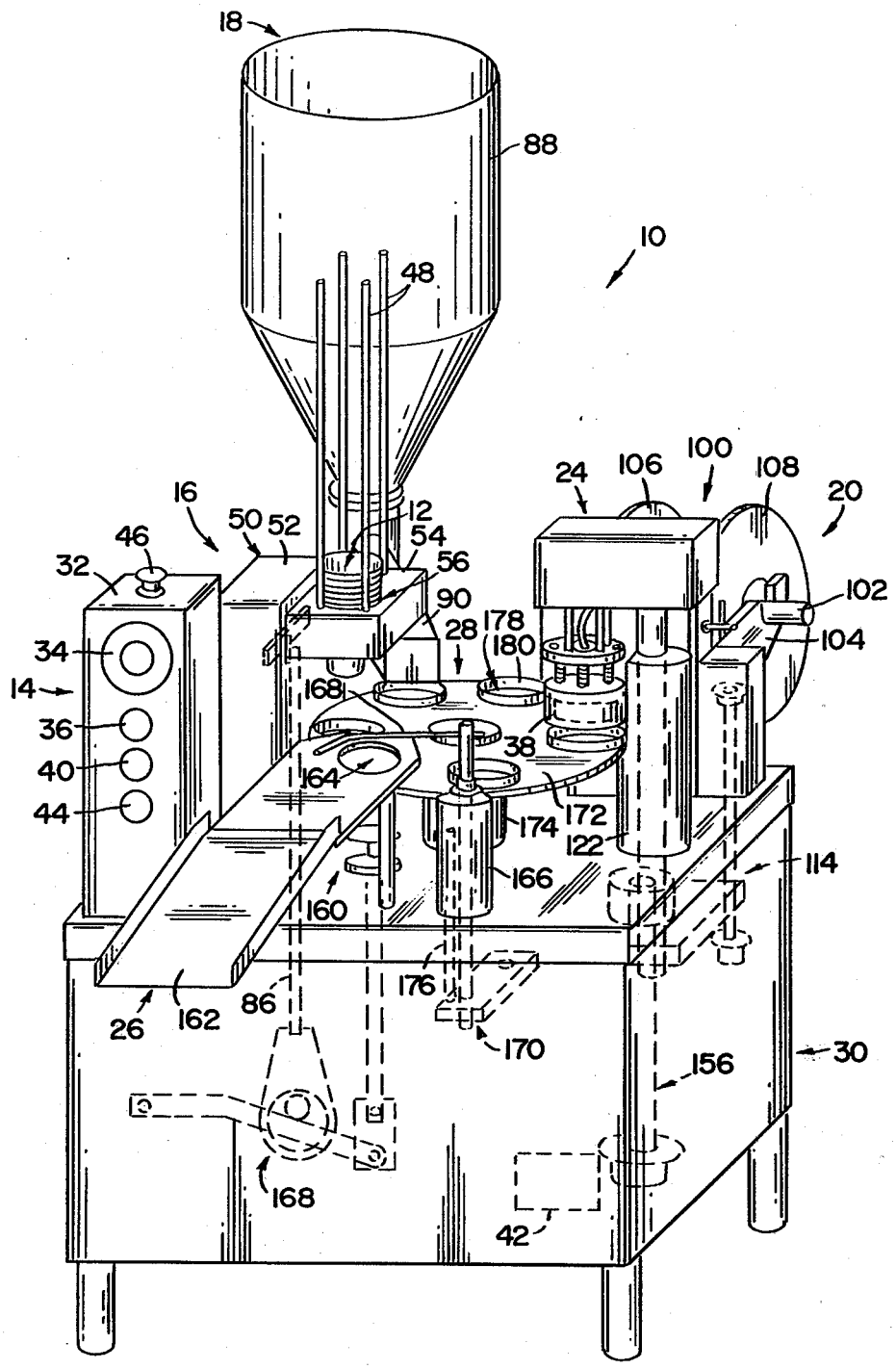
FIG. 1 is a perspective view of a liquid filling machine.

As best shown in FIGS. 1 and 2, the present invention relates to a liquid filling machine generally indicated as 10. The liquid filling machine 10 comprises a plurality of discrete stations that cooperatively provide a means of automatically filling plastic containers (cups) 12 with a liquid and capping the caps 12 for ultimate use. The plurality of discrete stations include a control module 14, a cup dispensing station 16, a liquid filling station 18, a foil supply station 20, a code identification station 22, a heat sealing station 24, a discharge station 26 and a rotatable turn table or container support 28 all operatively mounted on a base 30.

The control module 14 comprises state of the art circuitry disposed within a control housing 32. The controls include a temperature control dial 34 to selectively control the temperature of the heat sealing station 24, a heater "on/off" switch 36 to selectively activate the heater 38 within the heat sealing station 24, a machine "on/off" switch 40 to activate the power source or drive means 42, an incremental operator switch 44 and an emergency stop switch 46. Simultaneous actuation of the switches 40 and 44 will continuously actuate the machine 10 to periodically advance the container support 28 incrementally through each station. Actuation of the switch 44 causes incremental advance of the container support 28.

The cup dispensing station 16 comprises four (4) substantially vertical retainer members each indicated as 48 supported on a housing 50. The housing 50 comprises a first member 52 extending upwardly from the base 30 and a second member 54 including a cup feed aperture 56 extending outwardly therefrom. A cup release mechanism is disposed within the housing 50 to selectively feed the cups 12 to the container support 28 as more fully described hereinafter. As best shown in FIG. 3, the cup release mechanism comprises a pair of cup release elements on opposite sides of the cup feed aperture 6. Each cup release element comprises a first and second release member (phantom lines) 58 and 60 respectively. The first release member 58 comprises a first plate 62 including an aperture 64 to fixedly attached the first release member 58 on a rotatable shaft 66. An upper and lower release element 68 and 70 respectively extend outwardly from the first plate 62 in cup engaging disposition as more fully described hereinafter. An adjustable centering element 72 is movable attached to the lower edge of the first plate 62 by a fastner means 74 to permit selective movement of the adjustable centering element 72 relative to the first plate 62. The second release member 60 comprises a second plate 76 including an aperture 78 concentric aligned with an aperture 64 to rotatably mount the second release member 60 on the rotatable shaft 66. An upper stop element 80 extends outwardly from the second plate 76 in cup engaging disposition as more fully described hereinafter. The cup release element further includes a spring bias means 82 to normally bias the upper stop element 80 downward and a positioner or post 84 on the first plate 62 disposed to selectively engage the second plate 76 to provide rotation of first and second release members 58 and 60 as more fully described hereinafter. Upward movement of the second plate 76 is restricted by limit member 85 extending downwardly from the second member 54. The shaft 66 is coupled to the drive means or motor 42 by a mechanical coupling means partially indicated as 86.

The liquid filling station 18, affixed to the base 30, comprises a vertically disposed liquid reservoir 88 having a liquid fill nozzle 90 extending outwardly therefrom in liquid filling disposition relative to the container support means 28 as more fully described hereinafter. The filling station 18 is state of the art means to volumerically fill the cups 12 on the container support 28. A pair of control valves are activated by a piston which is in turn coupled to the drive means 42 by a mechanical coupling means generally indicated as 92 to selectively feed the liquid beverage to the cups 12.

As shown in FIGS. 1 and 2, the foil supply station 20 comprises a foil mounting means 100 including a substantially horizontal member or bar 102 supported by side plates 104 and 106 to hold a continuous roll of foil 108. The tape or foil is fed through a tape drive means comprising a lower metal drive roller and an upper rubber idle roller 110 and 112 respectively. This configuration allows the foil to preform in a downward trend since the rubber idle roller 112 tends to deform and follow the shape of the drive roller 110.

The drive roller 110 is mechanically coupled to the drive means or motor 42 by a drive linkage or mechanical coupling partially shown as 114. The foil supply station 20 further includes a cutting means comprising a substantially vertical cutting member or blade 116. As best shown in FIG. 4, the cutting blade 116 including a plurality of cutting elements 118 extending across a portion of the cutting blade 116. As described more fully hereinafter, the tape or foil is only partially cut or perforated. The cutting blade 116 is fixedly attached to a support member 120 operatively coupled to the drive motor 42 by a drive linkage or mechanical coupling partially shown as 122 to reciprocally move the support member 120 vertically. A substantially L-shaped plate 124 is attached to the base 30 having an inclined forming member 126.

The code identification station 22 comprises an embossing head 128 mounted on an interconnecting member 130 with a bias 132 mounted thereon and a resilient member 134 in the plate 124. A detachable coding plate 136 including an inclined tab 138 is mounted in a retainer means or groove 140. A securing means or magnetic means 142 are secured to the embossing head 128 to retain the coding plate 136 on the embossing head 128.

As best shown in FIG. 2 the heat sealing station 24 of essentially conventional design comprises a base 144, a plurality of support rods 146, a plate 148 with interconnecting rods 150 and a bias 152 extending downwardly therefrom. The heat sealing head 154 including a heater element 38 is attached to the lower portion of the interconnecting rods 150. The entire heat sealing station 24 is operatively coupled to the drive means 42 by a mechanical coupling partially shown as 156.

It should be noted that the cutting element 118 extends below the embossing head 128 and the heat sealing head 154 only in the lower or cutting position. As a result, when the embossing head 128 and the heat sealing head 154 engage the strip of foil, the sealing head 154 without a cup 12 no slice or cut only perforated thereafter continuous strip and no fouling.

The discharge station 26 comprises a lifter pedestal 160 mounted on the base 30 to move vertically between a lower and upper position relative to a discharge plate 162 including discharge aperture 164 to register with the container support 28 to received filled cups 12 therefrom. A wiper structure or means comprising a rotatable vertical wiper shaft 166 and a horizontal wiper arm 168 are mounted on the base 30 to sweep the cups 12 from the lifter pedestal 160 when in the upper position. The lifter pedestal 160 and the wiper shaft 166 are operatively coupled to the drive motor 42 by a drive linkage or mechanical couplings partially shown as 168 and 170 respectively.

The container support 28 comprises a circular horizontally disposed turn table 172 attached to the upper portion of a turn table shaft 174 operatively coupled to the drive motor 42 by a drive linkage or mechanical coupling partially shown as 176. A plurality of container retainers each comprising a container aperture 178 having an annular cup pocket 180 disposed therein are formed in the turn table 172.

In use the liquid filling machine 10 is normally actuated by the switches 40 and 44 together with actuation of the heater element through switch 36 and setting of the desired temperature by control dial 34. Alternately the machine 10 may be manually advanced incrementally by depression of the switch 44. The cups 12 vertically disposed within the retainer members 48 serially and singly fed through the cup feed aperture 56 under control the cup release mechanism. Specifically in the first or upper retainer position the upper lip of the cup 12 is engaged by the lower release element 70. Upon rotation of the shaft 66, the first release member 58 rotates downwardly while at the same time permitting the second release member 60 to follow through the spring bias action 82. As rotation continues through the horizontal, the upper release element 68 engages the upper lip of the cup forcing the lower most cup downwardly through the aperture 56 onto the container support means 28. Simultaneously the upper stop element 80 engages the lower portion of the next adjacent cup lip preventing it from following. The adjustable centering elements 72 on each side of the cup 12 maintains center line alignment to prevent the cup from inadvertently becoming dislodged from either the lower release element 70 or the upper stop element 80 during operation. Once the lower most cup 12 is released, the first and second release members 58 and 60 rotate upwardly for reloading. Specifically the shaft 66 rotates in the opposite direction causing the first release member 58 to rotate upwardly while the pin or element 84 engages the upper portion of second release member 60 and causing it to rotate upwardly with the first release member 58. The turn table 164 is then driven one increment immediately below the liquid filling station 18 where it is filled volumetrically from the beverage reservoir 88 through fill nozzle 90. As the turn table 164 continues to advance or rotate through two increments the uncapped cup 12 is disposed immediately below the heat sealing head 154. As the cup 12 passes from the liquid filling station 18 to the heat sealing station 24 the strip of foil is fed from the foil supply 20 to cover the opening of the cup 12. Once disposed beneath the heat sealing station 24 the heat sealing head 154, the cutting blade 116 and the coding plate 136 are moved downwardly such that the strip of foil is securely held between the code station 22 and heat sealing station 24 permitting a partial cutting of the strip. As the turn table 164 is then rotated, the strip bonded to the cup 12, the linear travel of the turn table 164 being relatively greater then the travel of the foil strip causes a tearing of the remaining portion of the strip releasing the foil closure formed on the cup 12.

As the turn table 164 continues to rotate, the pedestal 152 moves upwardly forcing the enclosed cup, 12 through the aperture 156 in the discharge plate 154. The wiper arm 160 then rotates, pushing the filled enclosed cup 12 down along the discharge plate 154. The operation is thus continued.

It should be noted that since the foil supply and strip are in line with the rotation of the turn table 164 there is no pocket hang-up or grab as is commonly associated with many such machines.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A liquid filling machine for automatically filling and enclosing containers comprising a plurality of discrete stations disposed in operative relation relative to a container support including a turn table rotatably mounted on a base, said plurality of discrete stations comprises a container dispensing station configured to operatively retain a plurality of containers in stacked array, a liquid filling station, a foil supply station comprising a foil mounting means to operatively support a continuous roll of foil thereon, and a heat sealing station comprising a heat sealing head operatively coupled to said drive means to move said heat sealing station between an upper and lower position, said heat sealing station being disposed relative to said container support to seal foil to the container when in said lower position, said heat sealing head includes a bias means to normally bias said heat sealing head in a lower position, such that said heat sealing head engages said foil on the container before said cutting blade engages said foil, operatively mounted on said base, said turn table includes at least one container aperture formed thereon to selectively receive containers from said container dispensing station, said container retainer further includes an annular pocket extending upwardly about the periphery of said container aperture to operatively support the container on said turn table, said foil supply station arranged to feed foil to said container support in line with direction of movement of said container support, said container support being operatively coupled to a drive means to selectively advance the container retained in said container retainer sequentially from said cup dispensing station to said liquid filling station to fill the container with liquid, from said liquid filling station to said foil supply station to cover the mouth of the container with foil and from said foil supply station to said heat sealing station to seal said foil to the container, said foil supply station further includes a cutting means comprising a cutting blade including a plurality of cutting elements extending across a portion of said cutting blade with said blade arranged to partially cut said foil when a container is supported on said annular pocket such that the foil cover is torn along said partial perforation when said container support is rotated.

2. The liquid filling machine of claim 1 wherein said container dispensing station includes a cup release mechanism comprising at least one cup release element operatively disposed within a housing to selectively feed containers to said container support through a cup feed aperture formed in said housing, said cup release element comprises a first release member, said first release member comprising a first plate fixedly attached to a rotatable shaft operatively coupled to said drive means movably between an upper and lower position, said first plate including an upper and lower release element extending outwardly therefrom in cup engaging disposition such that said lower release element retains containers when in said upper position and said upper release elemnts releases the lowermost container when in said lower position, and a second release member comprising a second plate rotatably mounted on said shaft, said second plate including an upper stop element extendingly outward therefrom in cup engaging disposition movable between an upper and lower position such that when in said lower position said upper stop element engages the stacked containers.

3. The liquid filling machine of claim 2 wherein said first release member further includes an adjustable centering element movably attached to the lower portion of said first plate to permit selective movement of said adjustable centering element relative to said first plate to center the container relative to said cup feed aperture.

4. The liquid filling machine of claim 2 wherein said cup release element further includes a bias means operatively engaging said second plate to normally bias said upper stop element downward and said first plate further includes a positioner to selectively engage said second element to move said second element between said upper and lower position.

5. The liquid filling machine of claim 4 wherein said shaft is coupled to said drive means by mechanical coupling means to selectively move said first and second release members between said cup retaining and cup dispensing positions.

6. The liquid filling machine of claim 2 wherein said cup release mechanism comprises a pair of cup release elements disposed on opposite sides of said cup feed aperture.

7. The liquid filling machine of claim 1 wherein said cutting blade is fixedly attached to a support member operatively coupled to said drive means by mechanical coupling move to reciprocally move said support member vertically relative to said foil tape between an upper and lower positions.

8. The liquid filling machine of claim 1 wherein foil supply station further includes a lower drive roller and an upper idler roller to feed foil to said heat sealing station.

9. The liquid filling machine of claim 8 wherein said foil supply station further includes a plate attached to said base having an inclined member to form said foil.

10. The liquid filling machine of claim 1 further including a code identification station comprises an embossing head to detachably retain a coding plate mounted thereon.

11. The liquid filling machine of claim 10 wherein said code identification station further includes a retainer means comprising a groove formed on the lower portion of said embossing head to receive said coding plate.

12. The liquid beverage filling machine of claim 10 wherein said code identification station further includes a securing means to secure said detachable coding plate to said embossing head.

13. The liquid beverage filling machine of claim 10 wherein said embossing head is mounted on said support member of said foil supply station by means of an interconnecting member extending downwardly therefrom, said embossing head including bias means to normally bias said embossing head in a lower position such that said embossing head engages said foil before said cutting blade engages said foil.

14. The liquid filling machine of claim 1 wherein said liquid filling machine comprises a liquid reservoir and liquid fill nozzle coupled to said drive means to selectively feed a predetermined supply of liquid to the container disposed within said container retainer.

15. The liquid filling machine of claim 1 further including a discharge station disposed to receive enclosed containers from said container support.

16. The liquid filling machine of claim 15 wherein said discharge station comprises a lifter coupled to said drive means to selectively move said lifter between an upper and lower position such that as said lifter moves between said lower to said upper position the container is removed from said container support.

17. The liquid filling machine of claim 16 wherein said discharge station further includes a discharge plate including a discharge aperture disposed above said lifter to receive the container from said container support when said lifter is in said upper position.

18. The liquid filling machine of claim 17 wherein said discharge station further includes a wiper arm coupled to said drive means to move said wiper arm between a first and second position such that the container is fed from said lifter to discharge plate when said lifter is in said upper position as said wiper arm moves from said first to said second position.

* * * * *